United States Patent [19]

Umemura et al.

[11] Patent Number: 4,774,414

[45] Date of Patent: Sep. 27, 1988

[54] LIQUID METAL ION SOURCE

[75] Inventors: Kaoru Umemura, Kokubunji; Tohru Ishitani, Sayama; Toshiyuki Aida, Chofu; Hifumi Tamura, Hachioji, all of Japan

[73] Assignee: Hitachi, Ltd., Tokyo, Japan

[21] Appl. No.: 86,093

[22] PCT Filed: Dec. 5, 1986

[86] PCT No.: PCT/JP86/00618

§ 371 Date: Aug. 12, 1987

§ 102(e) Date: Aug. 12, 1987

[87] PCT Pub. No.: WO87/03739

PCT Pub. Date: Jun. 18, 1987

[30] Foreign Application Priority Data

Dec. 13, 1985 [JP] Japan ..... 60-278925

[51] Int. Cl.[4] ..... H01J 1/05

[52] U.S. Cl. ..... 250/423 R; 313/359.1; 315/111.81

[58] Field of Search ..... 250/423 R, 423 F; 313/359.1, 362.1; 315/111.81

[56] References Cited

U.S. PATENT DOCUMENTS

| | | | |
|---|---|---|---|
| 4,367,429 | 1/1983 | Wang et al. | 250/423 R |
| 4,467,240 | 8/1984 | Futamoto et al. | 313/336 |
| 4,556,798 | 12/1985 | McKenna et al. | 250/396 R |
| 4,617,203 | 10/1986 | Jergenson | 427/294 |
| 4,624,833 | 11/1986 | Umemura et al. | 250/425 |
| 4,629,931 | 12/1986 | Clark et al. | 250/423 R |
| 4,670,685 | 6/1987 | Clark et al. | 250/425 |
| 4,686,414 | 8/1987 | McKenna et al. | 250/423 R |

*Primary Examiner*—Bruce C. Anderson

*Attorney, Agent, or Firm*—Antonelli, Terry & Wands

[57] ABSTRACT

This invention relates to a liquid metal ion source which melts a source material and extracts ions. Stable extraction of ions of at least one element selected from among As, P and B for a long period of time can be attained by using as a source material an alloy having a composition represented by the formula $L_X R_Y M_A$ wherein X, Y and A each stands for atomic percentage; L at least one element selected from among Pt, Pd and Ag; R at least one element selected from among As, P and B; M at least one element selected from among Ge, Si and Sb; $5<A<50$; $40<X<70$; and $X+Y+A=100$.

2 Claims, 3 Drawing Sheets

LIQUID METAL ION SOURCE

TECHNICAL FIELD

This invention relates to a liquid metal ion source suitable as an ion source for a maskless ion implanter, a micro-zone secondary ion mass spectrometer, a micro-zone deposition apparatus or the like. More particularly, the present invention is concerned with a liquid metal ion source suitable for stably extracting ions of at least one element selected from the group consisting of boron (B), phosphorus (P) and arsenic (As) for a long period of time.

BACKGROUND ART

In recent years, a liquid metal ion source has attracted attention, because it can emit an ion beam having a high brightness and a fine diameter of the order of submicrons, which provide a possibility that lithography, doping (implantation), etching, etc. involved in semiconductor processes can be conducted without the use of any mask (i.e., by the maskless method) which has conventionally been required or without resort to any chemical means.

The liquid metal ion source operates according to the following principle. First, a source material (liquid metal) which has been melted by means of resistance heating, electron bombardment, laser radiation or the like is fed to an emitter made of a high-melting material such as tungsten (W), molybdenum (Mo), tantalum (Ta) or silicon carbide (SiC) and having a sharply pointed tip. Application of a negative high voltage to an extraction electrode brings about concentration of an electric field at the tip of the emitter. When a high voltage is further applied and reaches a certain threshold value, the liquid metal located at the tip of the emitter forms a conical protrusion called Taylor Cone, leading to an extraction of ions from the tip.

When such a liquid metal ion source is intended for use in various fields, it is an important requisite that the liquid metal ion source can stably emit an intended ion beam for a long period of time.

Meanwhile, among n-type impurities for silicon semiconductors, the most important elements are arsenic (As) and phosphorus (P) while boron (B) is important with respect to p-type impurities. Phosphorus in the form of a simple substance has a melting point of 44.1° C., and the vapor pressure of $P_4$ at that temperature is as high as about 24 Pa, which makes it difficult to use phosphorus in the form of a simple substance as a source material for a liquid metal ion source. Similarly, arsenic in the form of a simple substance cannot be used as a ion source, because arsenic in the form of a simple substance has a melting point of 817° C. while its vapor pressure at that temperature is as high as $3.6\times10^6$ Pa. Further, boron in the form of a simple substance is also unsuited as a source material because of its high melting point of about 2400° C.

When an element in a simple substance form which emits an intended ion has a high vapor pressure or a high melting point as mentioned above, the intended element must be converted into an alloy or compound in combination with other elements in order to reduce the above-mentioned difficulties, and the alloy or compound is used as a source material. When the alloy or compound is used as a source material, the emitted ions contain ions of other elements and ions of molecules in combination with other elements besides the intended ion. In such a case, an effectively employed method is one in which a mass spectrometer is provided after the ion source to obtain only the intended ion. In fact, such a method has often been used conventionally. For example, when emission of silicon (Si) ions from a liquid metal ion source is intended, silicon is used as the source material not in the form of a simple substance having a melting point of about 1420° C. but in the form of an alloy thereof with gold (Au), i.e., Au-Si. The melting point of the alloy Au-Si in a eutectic composition form is about 370° C., i.e., much lower than that of silicon. The lowering in melting point advantageously contributes to reduction in electric power consumed during melting as well as reduction in frequency of heat damage to a heater or emitter and prevention of excessive evaporation of the source material.

With respect to extraction of As ions from a liquid metal ion source, the following source materials have been proposed: $Sn_{68}Pb_{24}As_8$ reported by Gamo et al. in Jpn. J. Appl. Phys. Vol. 19, No. 10 (Oct., 1980) L. 595 to 598 entitled "B, As and Si Field Ion Sources"; $Pd_{40}Ni_{40}B_{10}As_{10}$ reported by Wang et al. in J. Vac. Sci. Technol., Vol. 19, No. 4 Nov./Dec., 1158–1163 (1981) entitled "A mass-separating focused-ion-beam system for maskless ion implantation"; and a Pt-As alloy reported by Shiokawa et al. in J. Vac. Sci. Technol. B, Vol. 1, No. 4, Oct.–Dec. 1, 1117–1120 (1983) entitled "100 keV focused ion beam system with an E×B mass filter for maskless ion implantation."

Only one article on extraction of P ions from a liquid metal ion source has been reported by Ishitani et al. in Jpn. J. Appl. Phys., Vol. 23 (1984) L 330–332 entitled "Development of Phosphorus Liquid-Metal Ion Source." In this report, an alloy of copper with phosphorus, i.e., $Cu_3P$ (P concentration: 25% in terms of the number of atoms) is used as the source material. This report describes that, among emitted ions, $P^+$ has the highest intensity, and $P^{2+}$ has the second highest intensity with respect to phosphorus ions.

Further, with respect to extraction of B ions from a liquid metal ion source, there is an article reported by Ishitani et al. in Nucl. Instrum. & Methods, Vol. 218, 363–367 (1983) entitled "Mass-separated Microbeam System with a Liquid-Metal-Ion-Source." It is not favorable to use metallic materials as materials for an emitter or a heater (reservoir), because boron easily reacts with a metal at a high temperature, leading to a short service life of the ion source. However, in the above-mentioned fifth conventional ion source, an ion source life of 200 hr is attained by using an alloy (melting point: about 1000° C.) represented by the formula $Ni_{50}B_{50}$ as the source material and using an emitter made of a carbonaceous material called glassy carbon.

The above-mentioned conventional ion sources had the following problems. It is reported that mass analysis of ions emitted by using $Sn_{68}Pb_{24}As_8$ as the source material revealed that the amount of the emitted $As^+$ ions was as small as 0.4% based on the total of the emitted ions, that of $As^{2+}$ was 0.1% and $As^{3+}$ was 0.1% and that the service life was about 5 hr. As to a Pt-As alloy, it is reported that the life of the ion source was about 10 hr. With respect to the use of $CuP_3$ as the source material, an apparatus mounting an ion source which uses this source material needs provision of a high-resolution mass spectrometer having a mass resolution of at least 63, because the mass/electric charge ratio, i.e., m/e (m: mass number; e: electric charge number) of $P^+$ is 31 while that of a divalent Cu ion, i.e., $^{63}Cu^{2+}$ which is the other one of the elements constituting the source material is 31.5, i.e., the difference in m/e between the two elements is as small as 0.5. Further, it is reported that the service life of the ion source was about 20 hr. The boron ion source proposed by Ishitani et al. which uses an emitter made of a glassy carbon involves a problem that the source materials containing elements capable of emitting intended ions are limited in kind, because metals wettable with a carbonaceous material such as a glassy carbon is limited in kind, e.g., Ni is easily wetted while Pt, Cu, Pd, etc. are difficultly wetted.

As mentioned above, the prior art had various problems such as a short service life of ion sources and a small amount of ionic current with respect to As and P ion sources; and, with respect to B ions, a limited kind of source materials usable for emitting B ions due to a limited kind of metals wettable with a carbonaceous material which has been used for avoiding a reaction between B and the metal. Hence, in the prior art, the liquid metal ion source has not satisfactorily been applied for stably extracting As, P or B ions for a long period of time and for implanting the extracted ions into a Si semiconductor substrate.

In view of the above situations, there has been desired to develop a liquid metal ion source capable of stably emitting As ions, P ions or B ions, or ions of at least one kind of element out of these three kinds of element for a long period of time by making use of a source material which is relatively low in melting point, sufficiently wettable with the emitter, reservoir or heater, small in degree of selective evaporation of As or P and undergoes no significant change in melting point attributable thereto.

DISCLOSURE OF INVENTION

The present invention has been made under these circumstances, and an object of the present invention is to provide a liquid metal ion source from which ions of at least one element selected from among As, P and B can stably be extracted for a long period of time.

The above object can be attained by a liquid metal ion source comprising a reservoir which contains a source material in a molten state, an emitter which has been arranged so that said molten source material fed from said reservoir is emitted in the form of ions from the tip thereof and an extracting electrode which serves to extract ions from the tip of said emitter, characterized in that said source material is an alloy having a composition represented by the formula $L_X R_Y M_A$ wherein X, Y and A each stands for atomic percentage; L at least one element selected from among Pt, Pd and Ag; R at least one element selected from among As, P and B; M at least one element selected from among Ge, Si and Sb; $5<A<50$; $40<X<70$; and $X+Y+A=100$.

It is preferred that the source material comprises an alloy having a composition represented by the formula $L_X R_Y M_A$, wherein L stands for at least one element selected from Pd and Pt; R at least one element selected from As and P; $5<A<50$; $40<X<70$; and $X+Y+A=100$.

In order to stably obtain large amounts of ionic currents of As and P for which the extraction of ions from a liquid metal ion source by making use of an element in the form of a simple substance has been considered to be difficult due to their high vapor pressures although the ions thereof are regarded as important ones in Si semiconductor processes, the present inventors have attempted to develop a liquid metal ion source which uses an alloy containing As or P having a relatively low melting point and exhibiting a low vapor pressure when melted, which can provide emission of $As^+$ and $As^{2+}$, or $As^{2+}$ and $P^{2+}$ of which the m/e ratios are not near those of the other elements and which can make it possible to separate intended ions even by means of a mass spectrometer having a resolution of about 30 and to obtain $As^+$ and $As^{2+}$, or $P^+$ and $P^{2+}$ in the form of a simple substance ion beam, and arrived at the present invention.

The present inventors first attempted to extract As ions, P ions and B ions respectively from three alloys, i.e., an alloy of the formula $Ag_{75}As_{25}$ (melting point: about 540° C.), an alloy of the formula $Pt_{80}P_{20}$ (melting point: about 590° C.) and an alloy of the formula $Pt_{60}B_{40}$ (melting point: about 830° C.). However, there arose the following problems associated with the above three alloys.

Ag-As alloy and Pt-P alloy

Vigorous selective evaporation of As and P from the both molten alloys (liquid metals) occurred, which caused changes in composition ratios in Ag-As and Pt-P with time, leading to elevation of the melting point and finally resulting in a problem that the emission of As ions and P ions stopped 10 hr after the initiation of the emission. This is attributable to the high melting points of As and P.

With a view to suppressing the elevation of the melting points (i.e., selective evaporation of As or P) of the Ag-As alloy and Pt-P alloy and developing a source material capable of continuously emitting As ions or P ions for a long period of time, the elements Ag, As and Ge were mixed to prepare a ternary alloy having an atomic composition of the formula $Ag_{60}As_{32}Ge_8$. With respect to the P ion source, a ternary alloy having a composition of the formula $Pt_{68}P_{17}Sb_{15}$ was prepared from Pt, P and Sb. These alloys were mounted respectively on ion sources and melted to emit ions. As a result, it was found that both the alloys had a melting point of about 700° to 800° C. and continuously emitted As ions or P ions without causing any significant rise in the melting point even about 100 hr after initiation of emission of the ions. This is because the third elements, i.e., Ge or Sb which has been added to the Ag-As alloy or Pt-P alloy served to suppress selective evaporation of As or P, so that the melting points were stably kept for a long period of time. The amount of Sb or Ge to be added is preferably more than 5 atomic %. When the amount of the element is less than the above range, the added element does not sufficiently suppress the rise of the melting point. On the other hand, when Sb or Ge is added in an excessive amount and accounts for the major part of the above-mentioned ternary alloy, the amount of ionic current of intended As ions or P ions is remarkably decreased, causing lowering in practicality thereof for use as a source material for emission of As ions or P ions. Therefore, it is preferred that the amount of the third element, i.e., Sb or Ge, to be added be at most 50 atomic % based on the total.

The above-mentioned effect with respect to the suppression of the rise of the melting point attributable to addition of Sb or Ge can also be attained by addition of Si, and the addition of at least one element selected from among Sb, Ge and Si to the above Ag-As alloy or Pt-P alloy produces an effect with respect to suppression of the rise of the melting point. Further, a similar effect can also be attained when the metals constituting the matrix comprise a combination of As with Pt or Pd besides Ag and a combination of P with Ag or Pd besides Pt.

In this connection, it is to be noted that the elements Si, Sb and Ge to be added to the above-mentioned binary alloys, i.e., Ag-As, Pt-As, Pd-As, Ag-P, Pt-P and Pd-P, cannot easily be found out based on only known physical data such as the periodic table, constitutional diagram (phase diagram) of alloys and melting points. In other words, even though it can be expected that the addition of a third or fourth element to an alloy temporarily serves to lower the melting point of the alloy, whether or not the alloy to which the element has been added can satisfactory be used as a source material which is mounted on an ion source cannot be determined based on such expectation. This is because other important requisites should also be taken into account, such as necessity of suppressing selective evaporation for maintaining the melting point and composition of a liquid metal at a constant value for a long period of time and for stably feeding the liquid metal to an emitter at its tip to cause ionization of the metal and necessity of no occurrence of a reaction between the liquid metal and the emitter or reservoir for the source material. An alloy comprising, in combination, at least one matrix metal selected from among Pt, Pd and Ag, at least one intended element selected from As and P and at least one element to be added for suppression of the rise of the melting point selected from among Si, Sb and Ge can satisfactorily meet such strict requisites.

Pt-B alloy

As mentioned above, since B reacts chemically with metallic materials at high temperatures with great ease, tungsten (W) and molybdenum (Mo) which have been used for conventional liquid metal ion sources cannot be used as an emitter or reservoir material for an ion source. To solve such a problem, a carbonaceous material has been used for the emitter or reservoir to prevent the reaction with B. Since a molten Ni is highly wettable with a carbon aceous material, a Ni-B alloy has been used as a source material for B ions.

Thus, although the carbonaceous material exhibits an excellent effect with respect to suppression of the reaction with B, metals wettable with the carbonaceous material are limited in kind. A typical example of such a wettable metal is Ni. However, a source material comprising Ni as the matrix metal has the following drawbacks.

The effectiveness of emission of ions of an n-type dopant and a p-type dopant for a semiconductor substrate which is a target of ion implantation from one ion source can easily be understood from the fact that n-type ions and p-type ions can be selectively implanted by simply adjusting a mass spectrometer provided after the ion source. The n-type dopant and p-type dopant, e.g., for a Si substrate include As, P and Sb for n-type and B for p-type. If extraction of both the B (p-type) ions and P (n-type) ions from one ion source is desired as mentioned above, an emitter or reservoir made of a carbonaceous material should necessarily be used in view of the reactivity between B and the metals. Since Ni is easily wettable with the carbonaceous material, it is expected that a Ni-B-P alloy would be suitable as a source material for extracting both the B ions and P ions. However, when such an alloy is employed as the source material, $^{62}N^{2+}$ and $^{31}P^{+}$ cannot be separated from each other by means of a mass spectrometer, which makes it impossible to obtain a simple element ion beam consisting of $P^{+}$. This is attributable to the fact that the mass/electric charge ratio, i.e., m/e (m: mass; e: number of electric charges) of $^{62}Ni^{2+}$ is the same as that of $^{31}P^{+}$ and is 31. Thus, the use of Ni as the matrix metal has a fatal disadvantage that it cannot be used in combination with P.

The B-containing alloys other than the Ni-B alloy include Pt-B alloy and Pd-B alloy. However, since the both alloys are not wettable with a carbonaceous material at all, they cannot serve as an ion source at all. Even when the emitter or reservoir made of a metal is used, the service life of the ion source is as short as several hours. This is a fatal drawback.

The present inventors have made studies on a variety of elements to be added as the third or fourth element to the Pt-B alloy with a view to improving the wettability of the alloy with the carbonaceous material. As a result, the present inventors have found that Sb, Si and Ge are effective as the additive. For example, the comparison in terms of the ion source life showed that when a Pt-B alloy is used the ion source life is as short as several hours, while a Pt-B-Si ternary alloy is highly wettable with a carbonaceous material and provide a stable emission of ions which continues even about 100 hr after initiation of the emission. A similar effect could be attained by replacing Si with Sb or Ge, or by using at least two of these elements in combination.

It is preferred that the amount of Sb, Si and Ge to be added be at least 5 atomic %. When the amount is less than the above range, any satisfactory improvement in the wettability with a carbonaceous material can be attained. On the other hand, when Sb, Si or Ge is added in an excessive amount and amounts to the major part of the alloy, the amount of ionic current of intended B ions is decreased. Therefore, it is preferred that the amount to be added be at most 50 atomic % based on the total.

Such an effect can also be attained with respect to Pd-B alloy and Ag-B alloy besides Pt-B alloy.

BEST MODE FOR CARRYING OUT THE INVENTION

The examples of the present invention will now be described in more detail with reference to the attached drawings.

EXAMPLE 1

Figure 2:
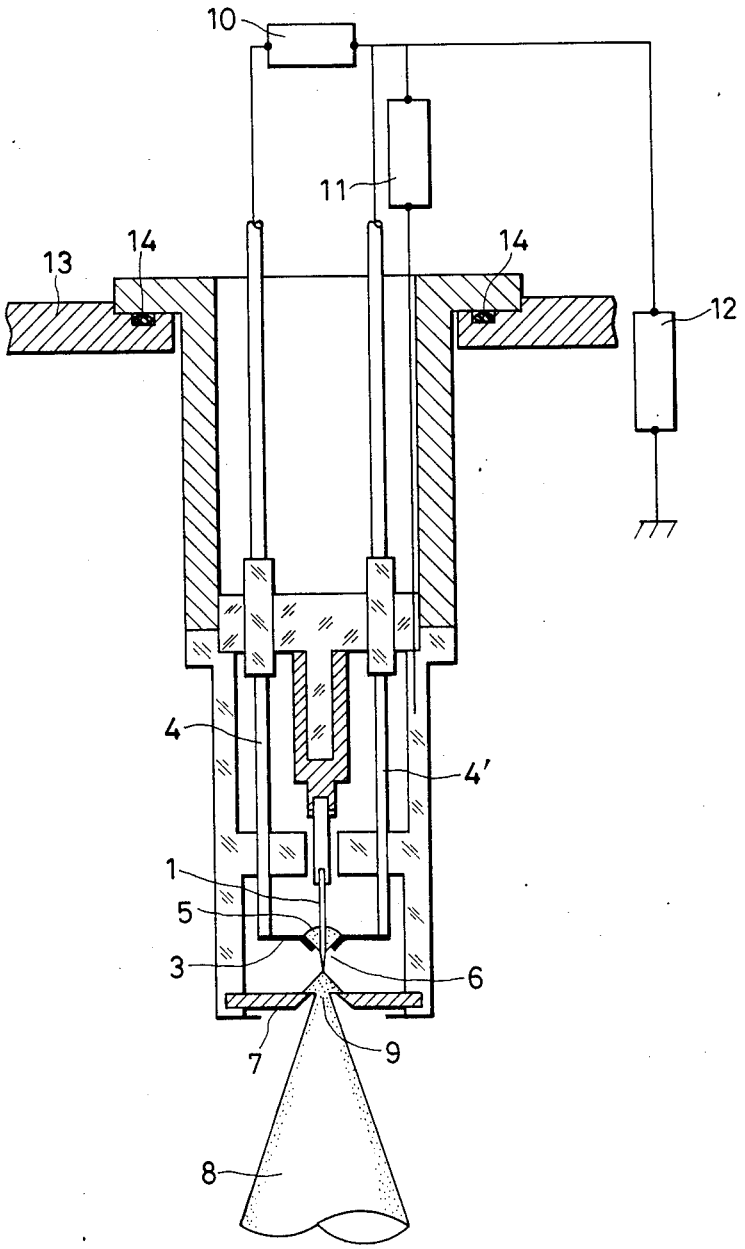
FIG. 2 a schematic cross-sectional view of a liquid metal ion source used in an example of the present invention.

FIG. 2 shows a constitution of a liquid metal ion source according to the present invention. A source material 5 for this ion source is melted by means of electroheating. An emitter 1 is connected to a support 2 which is connected to an insulating material 14. A reservoir 3 which serves also as an electroheating heater for melting the source material 5 is fixed at its both ends to electric current lead-in terminals 4,4'. The reservoir 3 at its center has a circular hole 6 through which the emitter 1 wetted with the source material 5 in a molten state is passed. FIG. 2 shows the emitter 1 wetted with the molten source material 5, which is protruded from the circular hole 6 provided at the reservoir 3. Numeral 7 designates an extracting electrode. The application of an electric field of a several kV between the electrode 7 and the emitter 1 brings about a downward extraction of an ion beam 8 from the emitter 1 through a through-hole 9 formed in the electrode 7. In the present example, the emitter is 0.3 mm in diameter and made of tungsten (W) and has a tip sharpened by means of electropolishing to such an extent that the radius of curvature is several μm. The reservoir 3 which serves also as a heater is made of a molybdenum (Mo) plate having a thickness of 0.1 mm, and the recess provided at the center thereof is worked so that it can store the source material 5 in an amount of several $mm^3$. The diameter of the circular hole 6 provided at the center of the reservoir 3 is about 1 mm.

In FIG. 2, numeral 10 designates a heating power source for the source material 5, numeral 11 an ion extracting power source, numeral 12 an ion accelerating power source and numeral 13 a vacuum container.

Figure 1:
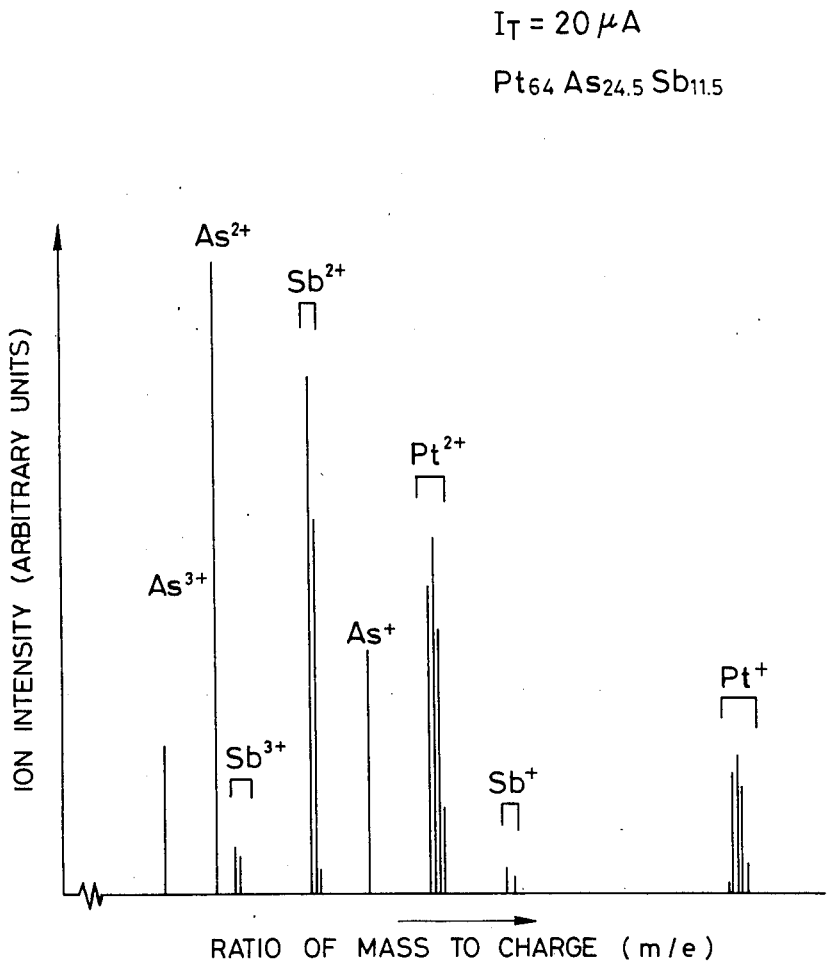
FIG. 1 is an illustrative view of a mass spectrum obtained in an example of the present invention.

In the present example, $Pt_{64}As_{24.5}Sb_{11.5}$ was used as the source material 5. The melting point of the source material 5 is about 600° C. The source material 5 was put on the heater 3 which served also as a reservoir and heated to about 700° C. When the ion source was then operated, an ion beam 8 was stably emitted. In order to subject the emitted ions to mass spectrometry, the ion source was mounted on a mass spectrometer (not shown) equipped with a magnetic sector. A typical example of the mass spectra thus obtained is shown in FIG. 1. The mass/electric charge ratio, i.e., m/e is plotted as abscissa and the ion intensity (arbitrary unit) is plotted as ordinate. The ion extracting voltage is 5.7 kV and the total emitted ion current is 20 μA.

From the spectrum, it can be seen that the present ion source emits ions such as $As^+$, $As^{2+}$, $Pt^+$, $Pt^{2+}$, $Sb^+$ or $Sb^{2+}$ and that with respect to As ions the ion intensity of $As^{2+}$ is higher than that of $As^+$.

A large amount of emission of $As^{2+}$ brings about the following effect. For example, it is expected that the ion source of the present invention can be applied to an ion implantation process for a semiconductor. $As^+$ which has been accelerated by means of a certain accelerating voltage V (kV) is implanted into a semiconductor substrate with an energy of V (keV). On the other hand, since $As^{2+}$ has a doubled energy, i.e., 2V (keV), $As^{2+}$ is implanted into the substrate more deeply than with $As^+$. Specifically, when $As^+$ and $As^{2+}$ which have been accelerated with V of 100 (kV) are implanted into a Si substrate, the penetrations (range) of $As^+$ and $As^{2+}$ are about 0.06 μm and 0.11 μm, respectively, i.e., $As^{2+}$ is larger in range. Therefore, the implantation of $As^+$ and $As^{2+}$ by properly making use of them enables these ions to be implanted to different depths at the same accelerating voltage.

The effect attained by the present example is that the addition of Sb to the Pt-As alloy suppresses the rise of the melting point of the source material, which effectively suppresses selective evaporation of As as compared with the case where conventional Pt-As binary alloy is used as the source material. Therefore, the present ion source can advantageously emit a desired As ions for a long period of time. Specifically, the present ion source continuously emitted As ions even 100 hr in total after initiation of ion emission without causing any significant change in both the ionic currents of $As^+$ and $As^{2+}$.

Further, the present example is also characterized by emission of Sb ions. Sb is also an element belonging to Group V and serves as a dopant for a Si substrate. Therefore, two kinds of n-type dopants which are different in mass from each other, i.e., As and Sb, can be emitted from the present ion source, and with respect to the both ions the divalent ions are emitted in larger amount.

With respect to the above-mentioned prevention of selective evaporation of As by addition of the third element to a Pt-As alloy which is a noble alloy, the same effect can be attained by using Si or Ge instead of Sb used in the present example and at least two elements selected from among Sb, Si and Ge. Specifically, $Pt_{64}As_{25}Si_{11}$, $Pt_{58}As_{22}Sb_{10}Si_{10}$, $Pt_{64}As_{25}Ge_{11}$, etc. can be used as the source material.

EXAMPLE 2

The same liquid metal source as the one used in Example 1 was used in this example, except that a source material having a composition of the formula $Pt_{68}P_{17}Sb_{15}$ and a melting point of about 600° C. was used as the source material 5 in this Example 2 instead of the source material 5 as used in Example 1.

Figure 3:
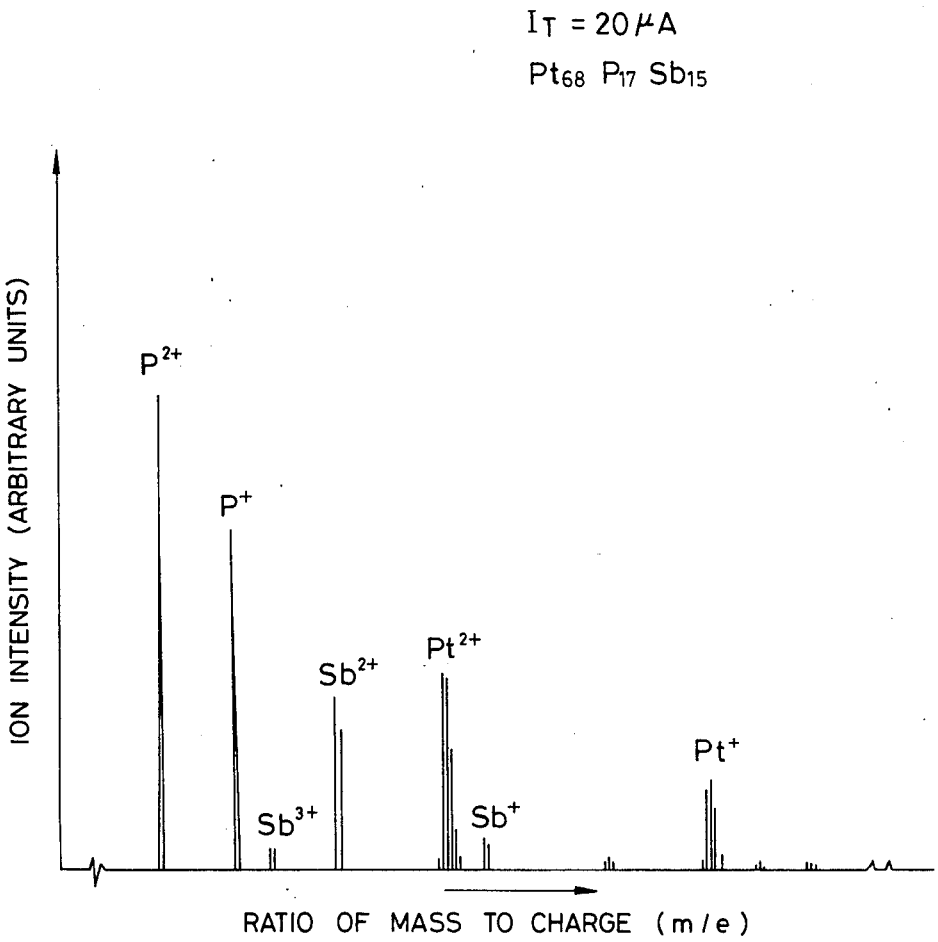
FIG. 3 an illustrative view of a mass spectrum obtained in another example of the present invention.

This ion source was operated at about 700° C., and it was confirmed that a stable ion was emitted. The results of the mass spectrometry of the emitted ions are shown in FIG. 3. The total emitted ionic current $I_T$ is 20 μA. The mass spectra show peaks of $P^+$, $P^{2+}$, $Sb^+$, $Sb^{2+}$, $Pt^+$, $Pt^{2+}$ and other peaks of molecular ions having a small intensity. The ion source of the present example continued to stably emit ions at a relatively low melting point (800° C. or below) as in Example 1, and no significant change in mass spectrum pattern was observed even 150 hr in total after initiation of ion emission. This suggests that no significant selective evaporation of P from the molten source material took place. The reason for this is believed to reside in that the incorporation of Sb suppressed the rise of the melting point.

The service life was about 200 to 300 hr, i.e., about 10 to 15 times longer than that of the Pt-P ion source.

It can particularly be seen from FIG. 3 that the ion intensity of $P^{2+}$ is higher than that of $P^+$.

When the source material is a Cu-P binary alloy, the ratio of intensity of $P^{2+}$ to that of $P^+$ emitted, i.e., $P^{2+}/P^+$ ratio, is extremely small. Particularly, with respect to emission of $P^{2+}$ there is no description in the prior art. However, in the present example, the intensity ratio $P^{2+}/P^+$ is about 1 to 3, i.e., $P^{2+}$ is emitted in an amount larger than that of $P^+$. It is noted in this connection that the intensity ratio $P^{2+}/P^+$ depends on the total emitted ionic current $I_T$ and that the ratio is maximum when $I_T$ is about 10 μA.

Since the ion intensity of $P^{2+}$ is higher, the use of the $P^{2+}$ ion beam for ion implantation leads to an advantage that $P^{2+}$ can be implanted more deeply than the monovalent ion.

Another effect attained by the present example is that the resolution of the mass spectrometer provided after the extracting electrode 7 in order to obtain a single beam of $P^{2+}$ may be small, because there exists no peak of other element ion around $P^{2+}$ peak, as can be seen from the mass spectrum shown in FIG. 3. In the present example, in order to obtain a $P^{2+}$ ion beam, the mass resolution may be 10 or less. On the other hand, with respect to the Cu-P ion source, in order to obtain an ion beam of $P^+$ which is the maximum peak in the P ions, it is necessary to separate $^{31}P^+$ from $^{63}Cu^{2+}$, which requires the use of a mass spectrometer having a mass resolution of 62. Therefore, the resolution required for separating $P^{2+}$ from the Pt-P-Sb ion source may be 1/6.

With respect to the above-mentioned prevention of selective evaporation of P by addition of the third element to a Pt-P alloy which is a noble alloy, the same effect could be attained by replacing Sb in the above ternary alloy Pt-PSb with Si or Ge or Si and Ge, Si and Sb, Sb and GE, or Si and Sb and Ge, i.e., at least one element selected from among Sb, Si and Ge. Specifically, $Pt_{64}P_{16}Si_{20}$, $Pt_{67}P_{16.5}Ge_{16.5}$, $Pt_{64}P_{16}Sb_{10}Si_{10}$, $Pt_{60}P_{15}Ge_{12}Si_{13}$, etc. can be used as the source material.

EXAMPLE 3

Ag, As and Ge powders were mixed so that the atomic composition is $Ag_{60}As_{32}Ge_8$. The mixture was molded with a compression molding machine into a cylindrical shape having a diameter of 5 mm and a height of 10 mm. A glass-made ampule was charged with the resulting molding and then sealed with Ar under pressure. The ampule was placed in an electric oven to melt the molding of Ag-As-Ge. The sealing with Ar under pressure is for prevention of evaporation of As during melting.

The melting points of Ag and As are lowered to about 540° C. in the form of a composition $Ag_{75}As_{25}$. Since Ag and As both exhibit a high vapor pressure when melted in the form of a simple element, they cannot be used as the source material. Further, with respect to the binary alloy Ag-As, the melting point thereof rises several hours after initiation of emission, which makes it difficult to stably extract ions. This is also attributable to the fact that Ag and As evaporate to change the composition of Ag-As. However, the incorporation of Ge in the Ag-As binary alloy suppressed the rise of the melting point and maintained the alloy in a molten state at substantially the same temperature for a long period of time, which led to continuous feeding of the liquid metal to the tip of the emitter. As a result, the ion source continued to stably emit a desired As ions even 100 hr in total after initiation of emission of ions.

The above-mentioned effect could also be attained by replacing Ge in the above ternary alloy Ag-As-Ge with Sb or Si or Sb and Si, Si and Ge, and Sb and Ge. Specific examples of such compositions include $Ag_{60}As_{24}Sb_{16}$, $Ag_{60}As_{25}Si_{15}$, $Ag_{55}As_{21}Sb_{14}Ge_{10}$, $Ag_{54}As_{23}Si_{13}Sb_{10}$, $Ag_{54}As_{23}Si_{13}Ge_{10}$ and $Ag_{50}As_{21}Si_{12}Sb_9Ge_8$. These alloys exhibit no significant change in melting point, and the effect attained by adding Si, Sb and Ge to the noble alloy Ag-As was observed.

In the present example, it is noted that the use of a mass spectrometer having a resolution of at least 75 is required for separation of monovalent ions of $^{74}Ge$ and $^{76}Ge$ which are isotopes of Ge from monovalent ions of $^{75}As$ and separation of divalent ions of $^{74}Ge$ and $^{76}Ge$ from divalent ions of $^{75}As$.

EXAMPLE 4

In the present example, a Pt-B-Si ternary alloy was used as a source material. As Pt-B eutectic alloy ($Pt_{60}B_{40}$: melting point of about 830° C.) powder and a Pt-Si eutectic alloy ($Pt_{77}$-$Si_{23}$: melting point of about 830° C.) powder were mixed. The mixture was molded with a compression molding machine into a cylindrical shape in the same manner as in Example 3. The molding was melted in an electrical oven to obtain a $Pt_{65}B_{28}Si_7$ ternary alloy.

As mentioned above, since B and alloys containing it react in a molten state with other metals, tungsten (W) and molybdenum (Mo) which have conventionally been used for liquid metal ion sources cannot be used as materials for the emitter and the reservoir. In some cases, a carbonaceous material has been used to solve this problem. However, metals wettable with the carbonaceous material are limited in kind, and Pt, Pd, etc. are hardly wetted with the carbonaceous material. Therefore, difficulties are encountered in constructing a liquid metal ion source using a Pt-B alloy as a source material and a carbonaceous material as a material for the emitter and the reservoir. However, the addition of Si to the Pt-B alloy improved wettability thereof with the carbonaceous material. Specifically, when an emitter made of tungsten carbide (WC) and a reservoir, which served also as a heater, made of carbon (C) was used, ions were stably emitted. As a result of mass analysis, it was found that the ionic current of the desired $B^+$ ions amounted to about 20% of the ionic current which have reached the sample. The ionic current of $B^+$ hardly changed even 100 hr after initiation of emission of ions, which suggested that ions was stably emitted from the ion source.

With respect to the above-mentioned improvement in wettability by adding the third or fourth element to a B containing alloy which is difficulty wetted with a carbonaceous material, the same effect as the one in Example 5 could be attained by incorporating a Pd-B alloy and an Ag-B alloy with Si or Sb or Ge, or at least two elements out of the above three element in combination. Of course, the same effect can be attained by incorporating a Pt-B alloy with Sb or Ge, or at least two elements in combination selected from among Si, Sb and Ge. Specific examples of such compositions include $Pd_{58}B_{22}Sb_{20}$, $Pd_{66}B_{24}Ge_{10}$, $Pt_{54}B_{36}Ge_{10}$, $Ag_{67}B_{23}Sd_{10}$, $Ag_{67}B_{23}Si_{10}$, $Ag_{67}B_{23}Ge_5Si_5$ and $Pt_{53}B_{25}Sb_7Ge_5$.

EXAMPLE 5

In the present example, a Pt-B-P-Sb quaternary alloy was used as the source material. Specifically, Pt was used as a matrix metal, Sb as an element for suppression of the rise of the melting point and two elements B and P as desired elements. This ion source is for emitting two kinds of elements, i.e., n-type (P) and p-type (B).

Conventionally, Pt-B and Pt-P liquid metals had a problem that they could not be wetted with a carbonaceous material, and the Pt-P alloy also had a problem with selective evaporation. Therefore, difficulties were encountered in developing an ion source which used Pt as a matrix material and emitted both of B and P ions from one ion source. Although it is possible to emit B and P ions while sacrificing the service life of the ion source by using a metallic material such as tungsten for the emitter and the reservoir and further lowering the B content to avoid the reaction with the metal, such a method is disadvantageous from a practical point of view.

However, in the present example, the above problem was solved by adding Sb to the Pt-B-P alloy. Specific Example of such a composition includes $Pt_{64}B_{23}P_7Sb_6$.

The present example brings about the following effects. Specifically, it is needless to say that ions of n-type (P and Sb) and p-type (B) could be emitted from one ion source. The addition of Sb reduced selective evaporation of P, and there was caused no significant changes in the melting point of the source material and in emitted ion intensity even about 100 hr in total after initiation of emission of ions. Further, the addition of Sb improved the wettability with a carbonaceous material and enabled the use of carbides such as tungsten or titanium carbide as materials for the emitter and the reservoir. Since these materials do not react with B, the service life of the ion source can be improved even when a source material containing B in an increased amount is used.

With respect to the above-mentioned suppression of the rise of the melting point accompanying evaporation of an element having a high vapor pressure and the improvement in wettability with a carbonaceous material, the same effect can be attained by using Si and Ge instead of Sb in the above-mentioned quaternary alloy.

Further, the same effect can be attained by replacing P in the above-mentioned quaternary alloy with As.

Besides Examples 1 to 5, there were conducted some experiments on emission of ions with respect to the source material containing varied amounts of P, As and B. As a result, it was found that in order to increase the ionic current of desired P, As or B, it was preferred to increase the amount to be added. However, too large an amount of P, As or B causes P and As to be easily evaporated during melting of a source material as well as causes the rise of the melting point due to an increase in the amount of B. Selective evaporation of P and As brings about changes in composition of the source material, which leads to the rise of the melting point. From this, there arise problems such as necessity of an increase in the current for heating a heater in order to melt these metals and a decrease in the ionic current of P or As due to evaporation of P and As. Therefore, in order to reduce selective evaporation of P and As, to keep a relatively low melting point (600° to 1000° C.) for a long period of time and to attain a stable ionic current of a desired element for a long period of time, it is preferred that the amount of P, As or B to be added be at most 50 atomic % based on the total amount of the composition.

INDUSTRIAL APPLICABILITY

As is apparent from the foregoing descriptions, the present invention can provide a liquid metal ion source capable of stably extracting ions of at least one element selected from among phosphorus (P), arsenic (As) and boron (B) for a long period of time. The liquid metal ion source of the present invention can be used as an ion source for an ion implanter, a micro-zone secondary ion mass spectrometer, a micro-zone deposition apparatus or the like.

We claim:

1. In a liquid metal ion source comprising a reservoir which contains a source material in a molten state, an emitter which has been arranged so that said molten source material fed from said reservoir is emitted in the form of ions from the tip thereof and an extracting electrode which serves to extract ions from the tip of said emitter, the improvement wherein said source material is an alloy having a composition represented by the formula $L_X R_Y M_A$ wherein X, Y and A each stands for atomic percentage; L at least one element selected from a group consisting of Pt, Pd and Ag; R at least one element selected from a group consisting of As, P and B; M at least one element selected from a group consisting of Ge, Si and Sb; $5<A<50$; $40<X<70$; and $X+Y+A=100$.

2. A liquid metal ion source according to claim 1, wherein said source material is an alloy having a composition represented by said formula wherein L stands for at least one element selected from a group consisting of Pt and Pd and R at least one element selected from a group consisting of P and As.

* * * * *